US005340109A

United States Patent [19]

Miller

[11] Patent Number: 5,340,109

[45] Date of Patent: Aug. 23, 1994

[54] PIVOTING GOLF MAT

[76] Inventor: Omer E. Miller, 416 Wildwood Dunes Trail, Myrtle Beach, S.C. 29572

[21] Appl. No.: 155,821

[22] Filed: Nov. 23, 1993

[51] Int. Cl.[5] ..... A63B 69/36

[52] U.S. Cl. ..... 273/186.1; 273/183.1; 273/184 R; 273/185 R; 273/187.1; 273/195 R

[58] Field of Search ..... 273/186.1, 35 R, 183.1, 273/184 R, 185 R, 187.1, 195 R, 197 R

[56] References Cited

U.S. PATENT DOCUMENTS

| | | | |
|---|---|---|---|
| 3,542,369 | 11/1970 | Anderson | 273/187.1 |
| 3,717,349 | 2/1973 | Bohnen | 273/186.1 |
| 3,815,923 | 6/1974 | Goduto | 273/186.1 |
| 4,023,811 | 5/1977 | DeCota . | |
| 4,130,283 | 12/1978 | Lindquist | 273/186.1 X |
| 4,465,281 | 8/1984 | Whitfield | 273/186.1 |
| 4,928,966 | 5/1990 | Miller . | |
| 5,028,052 | 7/1991 | Miller . | |
| 5,110,133 | 5/1992 | Durso | 273/187.1 X |
| 5,273,285 | 12/1993 | Long | 273/187.1 X |

FOREIGN PATENT DOCUMENTS

| | | |
|---|---|---|
| 2039465 | 8/1980 | United Kingdom . |
| 2095564 | 10/1982 | United Kingdom . |

*Primary Examiner*—Vincent Millin
*Assistant Examiner*—Raleigh W. Chiu
*Attorney, Agent, or Firm*—Bacon & Thomas

[57] ABSTRACT

A pivoting golf mat assembly is disclosed which will provide a visual indication of the path of the club head during a golf swing involved in hitting a golf ball from the golf mat. The golf mat assembly has an anchor plate which is stationarily mounted on a support surface and to which is pivotally attached a golf mat having a hitting surface from which a golf ball can be struck. A plurality of support feet are mounted on the underside of the golf mat so as to slidably support the golf mat on the surface. Movement of the club head during the golfer's swing as it strikes a golf ball off the hitting surface of the golf mat will cause pivoting movement of the golf mat relative to the anchor plate should the path of travel of the clubhead not be parallel to the intended path of travel of the golf ball. The golf mat remains in the position after the ball has been struck enabling the golfer to view the golf mat and quickly ascertain any defects in the path of travel of the clubhead.

21 Claims, 4 Drawing Sheets

PIVOTING GOLF MAT

BACKGROUND OF THE INVENTION

The present invention relates to a practice aid for golfers, more particularly a practice golf mat which is capable of pivoting to visually indicate the path of travel of the golf club as it hits a ball off the golf mat.

The intricacies of the game of golf are such that a goiter is required to put in innumerable hours of practice in order to obtain and maintain a desired level of proficiency. One of the important factors in improving one's golf game is the path of the club head as it strikes the golf ball. Failure to consistently swing the golf club such that the club head travels along the desired path will impart movement to the golf ball which will cause it to hook or slice, depending upon the club head path.

Although swinging the club along the proper path is extremely important to establishing and maintaining a consistent golf game, as a practical matter, it is one of the most difficult elements of the game to practice properly. In fact, it is virtually impossible for a golfer to observe and analyze the path of club head travel during his swing without resorting to professional instruction, or expensive and complicated video taping systems. Many golfers are simply unable to afford the time of a professional instructor, nor can they afford the expense of complex video taping systems.

Practice golf mats are known which simulate the feel of actual turf and which may include movable portions to avoid inducing severe shocks to the golfer caused by contact between the club head and the golf mat. In such known golf mats, the movable portion will typically move only in one direction and will automatically return to its initial position after the contact between the club head and the golf mat. Such golf mats provide no indication to the golfer of the path of his swing, since they automatically return to their initial positions before the golfer can view the golf mat.

SUMMARY OF THE INVENTION

A pivoting golf mat assembly is disclosed which will provide a visual indication of the path of the club head during a golf swing involved in hitting a golf ball from the golf mat. The golf mat assembly has an anchor plate which is stationarily mounted on a support surface and to which is pivotally attached a golf mat having a hitting surface from which a golf ball can be struck. A plurality of support feet are mounted on the underside of the golf mat so as to slidably support the golf mat on the surface.

If the practice golf mat according to the invention is utilized on a ground surface, or the like, spikes may be driven into the ground through the anchor plate to hold the golf mat in position. If the golf mat is to be utilized on a hard surface, the anchor plate may be tethered to a weighted object, such as a golf bag, to hold the mat in position.

Once the pivoting golf mat is anchored, the movement of the club head during the golfer's swing as it strikes a golf ball off the hitting surface of the golf mat will cause pivoting movement of the golf mat relative to the anchor plate should the path of travel of the clubhead not be parallel to the intended path of travel of the golf ball. Thus, an inside-out, or an outside-in swing will cause the golf mat to pivot about its attachment to the anchor means. The golf mat remains in the position after the ball has been struck enabling the golfer to view the golf mat and quickly ascertain any defects in the path of travel of the clubhead. To assist a golfer in his evaluation, visual indicia may be included between the anchor plate and the golf mat so as to be readily viewed by the golfer after his swing. Friction between the support surface and the golf mat is reduced by utilizing a plurality of support feet to support the golf mat on the surface and to enable its easy pivoting movement.

DETAILED DESCRIPTION OF THE PREFERRED EMBODIMENT

Figure 2:
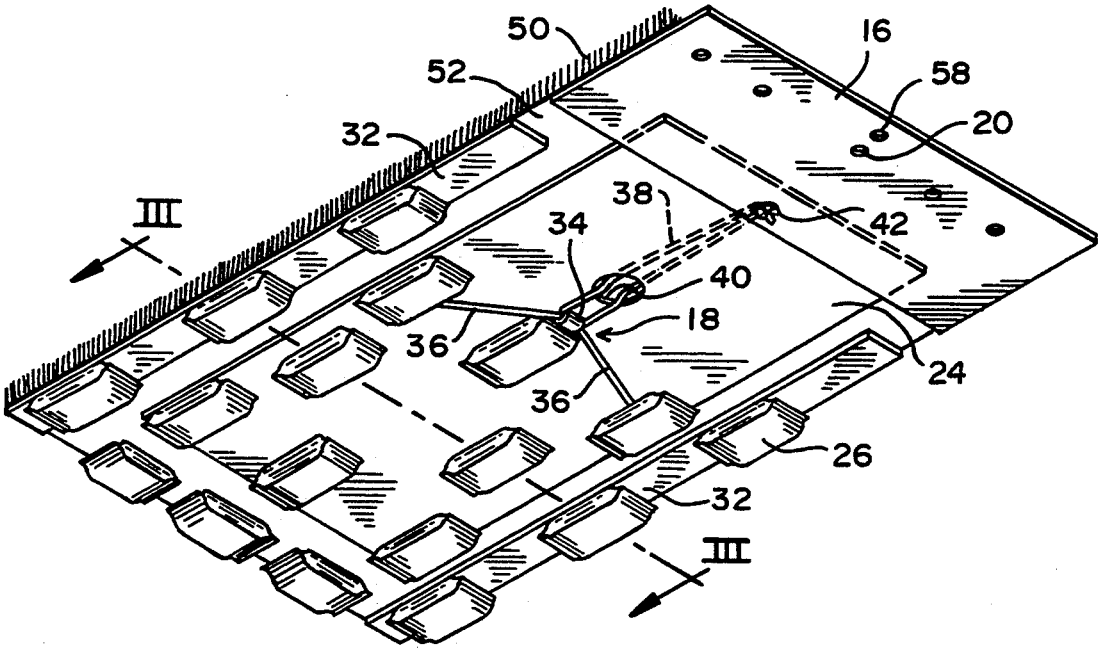
FIG. 2 is a perspective view of the pivoting golf mat of FIG. 1 illustrating the bottom of the golf mat.

The pivoting golf mat assembly according to the present invention comprises a golf mat 10 having a golf ball hitting surface 12 and a ramp surface 14. Golf mat 10 is pivotally attached to anchor plate 16 via a pivot attaching means, generally indicated at 18 (see FIG. 2). Anchor plate 16 defines one or more holes 20 through which one or more spikes 22 may be inserted in order to affix the anchor plate to a support surface, such as the ground, or the like. Although five such holes 20 are illustrated in FIG. 2, it is to be understood that more or less than this number may be utilized without exceeding the scope of this invention.

Golf mat 10 also comprises a base member 24 which is fixedly attached to the underside of the golf mat 10. Base member 24 may comprise a thin, flexible plastic material and may be fixedly attached to the underside of the golf mat 10 via adhesive or other known means.

Figure 3:
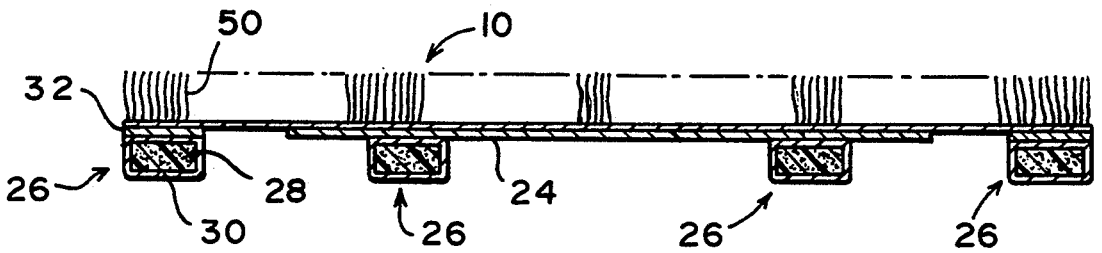
FIG. 3 is a cross-sectional view taken along line III—III in FIG. 2.

A plurality of support feet 26 are fixedly attached to the underside of the golf mat 10 and the base member 24. As best illustrated in FIG. 3, the support feet 26 each have a core of resilient foam material 28 substantially enclosed by a cover 30. The support feet 26 may be directly attached to the underside of the golf mat 10, or may be first attached to flexible strips 32 which are, in turn, attached to the underside of the golf mat 10. Flexible strips 32 may also be made of a thin, plastic material. The support feet 26 support the golf mat 10 on a surface, such as the ground, so as to reduce the friction between the golf mat and the surface to enable the golf mat 10 to slide on the surface.

In a first embodiment, the pivot attaching means 18 comprises a tubular member 34 which may be formed of a resilient plastic material and which has a hollow opening extending through its center. A first attaching strand 36, which may be twine or the like, extends through the center opening of the tubular member 34 and has opposite ends (not shown) fixedly attached to the base member 24. A second flexible attaching strand 38, which may be twine or the like, also passes through the central opening of the tubular member 34 as well as through opening 40 defined in the base member 24. The opposite ends of the second flexible attaching strand 38 pass through openings 41 and 42 defined in the base member and the anchor plate 16, respectively, and may be knotted or tied together such that the ends may not pass back through the opening 42. Thus, as can be seen, the attachment means allows the golf mat 10 to pivot relative to the anchor plate 16 via the knotted connection extending through hole 42 defined in the anchor plate 16. The pivoting action will take place along a generally vertical axis 44.

Figure 1:
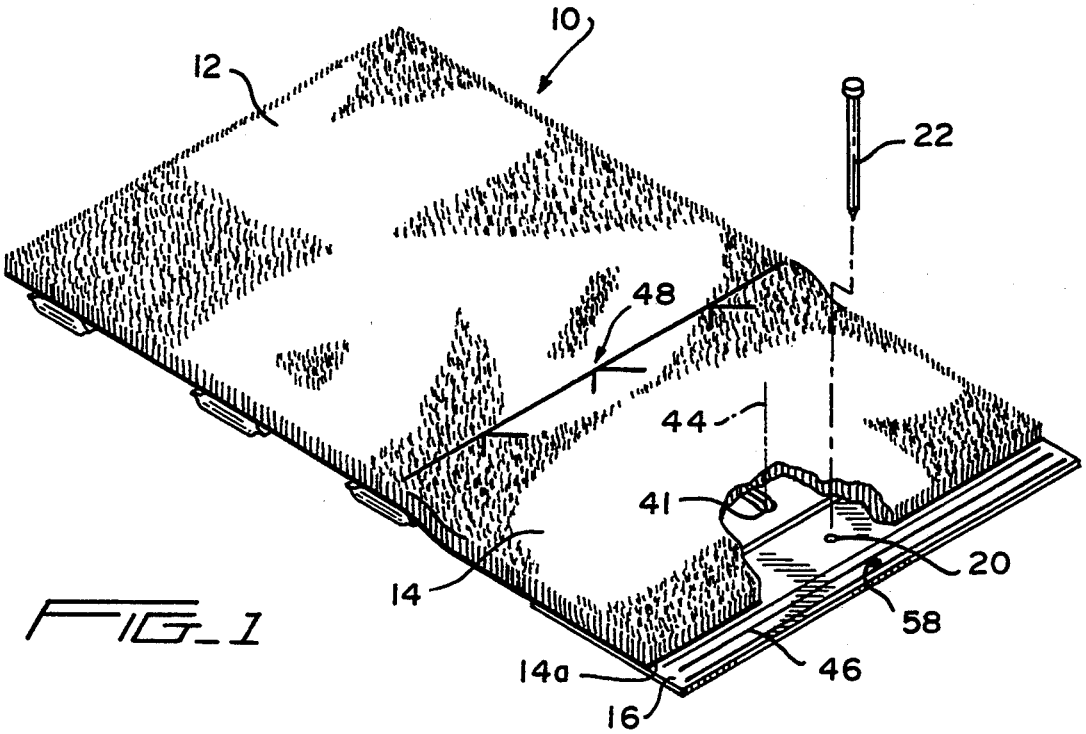
FIG. 1 is a perspective view, partially broken away, illustrating a first embodiment of a pivoting golf mat according to the present invention.
Figure 4:
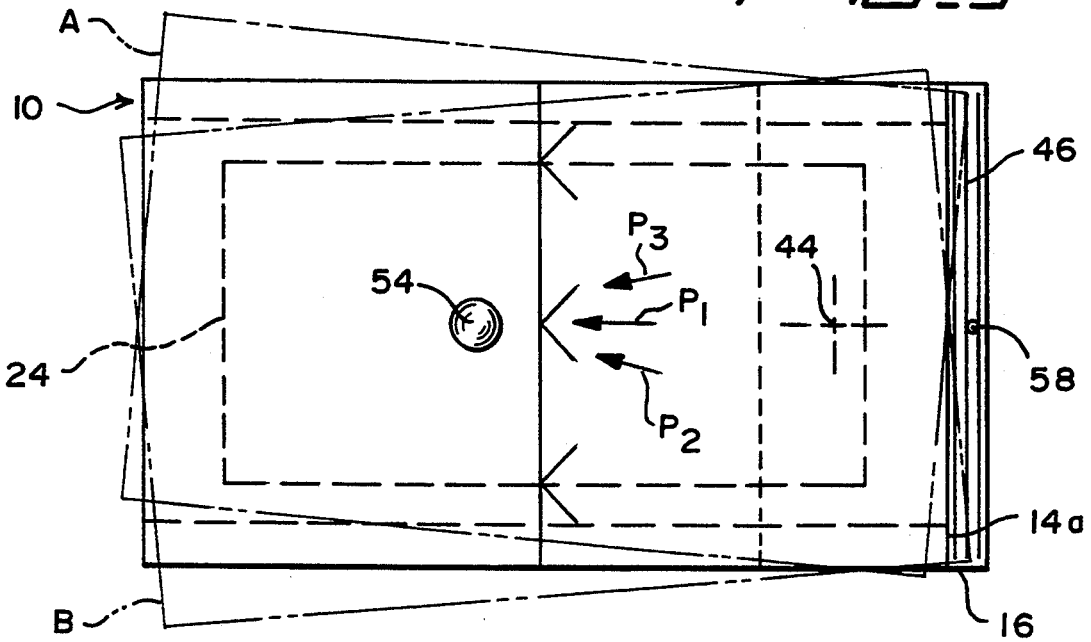
FIG. 4 is a top, plan view of the golf mat of FIG. 1 with movement of the golf mat illustrated in dashed lines.

As can be seen in FIGS. 1, 2 and 4, one end of the attaching plate 16 extends beyond the edge portion **14*a* of the golf mat 10. Visual indicia may be located on an upper surface of the portion of the anchor plate 16 which extends beyond edge portion 14*a* to indicate any skewness between the anchor plate 16 and the golf mat 10. The visual indicia may take the form of one or more lines 46 on the exposed surface of anchor plate 16**. Quite obviously, other forms of visual indicia may be utilized without exceeding the scope of this invention.

The upper surface of the golf mat 10 may also have visual indicia 48 thereon to indicate to the golfer the separation between the hitting surface 12 and the ramp surface 14. It is envisioned that the golf mat will be formed from a material having a plurality of generally upstanding fibers 50 attached to a mat backing 52 in known fashion.

In use, as best illustrated in FIG. 4, a golf ball 54 is placed on the hitting surface 12 and the golf mat 10 is positioned, as indicated by the solid lines, such that the edge **14*a* is parallel to or in alignment with the visual indicia 46 on the anchor plate 16. If the golfer's swing is such that the club head (not shown) travels along the path indicated by arrow $P_1$ along the desired flight path of ball 54, the contact between the clubhead and the golf mat 10 will produce no pivoting movement relative to the anchor plate 16. After hitting the ball, the golfer may observe the relationship between the visual indicia 46 and the edge portion 14*a* to evaluate his swing. Should the golfer's swing be such that the club head travels along path $P_2$, contact between the clubhead and the golf mat 10 will cause the golf mat to pivot relative to the anchor plate 16 and assume the position illustrated at A by the dashed lines. If the golfer's swing is such that the clubhead travels along path $P_3$, the contact between the clubhead and the golf mat 10 will cause the golf mat 10 to pivot to the position illustrated at B in FIG. 4. In either case, the mat will remain in its pivoted position after the golfer completes the swing such that the golfer may readily ascertain the path of the swing merely by examining the relative positions between the visual indicia 46 and the edge 14*a*** of the golf mat.

The pivoting golf mat according to the present invention may also be utilized on hard surfaces which will not permit the insertion of spikes 22. This may be accomplished by attaching a tether line 56 to the anchor plate 16 through hole 58 and connecting the opposite end of the tether line 58 to a weighted object, such as golf bag 60.

A second embodiment of the present invention is illustrated in FIGS. 6–9. Elements of this embodiment which are the same as those in the previously embodiment have been indicated by the same numerals with a prime added. Thus, golf mat 10' again comprises a golf ball hitting surface 12' having a ramp surface 14' with indicia 48' indicating to the golfer the separation between the golf ball hitting surface and the ramp surface. Base member 24', which, again, may be formed of a flexible plastic material, is affixed to the mat backing 52' of the golf mat 10' which has a plurality of upstanding fibers 50' to define the golf ball hitting surface 12' and the ramp surface 14'. A plurality of support feet 26' are fixedly attached to the underside of the base member 24'. As in the previously described embodiment, each of the support feet 26' comprise a core of resilient foam material 28' substantially enclosed by a cover 30'.

In this embodiment, the anchor plate 16' is located below the support feet 26' and covers substantially the entire area of the golf mat 10'. As in the previously described embodiment, anchor plate 16' may be formed of a flexible plastic material, but may also have a grid 62 adhesively bonded to the lower surface thereof, which grid may be a rubberized plastic material to impart non-slip characteristics to the lower surface of the anchor plate 16'. The non-skid grid 62 rests upon the support surface and serves to prevent movement of the anchor plate 16' during the swing of the golf club.

The base member 24' is pivotally attached to the anchor plate 16' via a resilient, elastic member 64 which extends, in serpentine fashion, through openings formed in both the anchor plate 16' and the base member 24'. Elastic, resilient rubber strand 64 has opposite ends attached by any means to either the anchor plate 16' or the base member 24'. The holes formed in the anchor plate 16' and the base member 24' to accommodate the elastic member 64 are sufficiently larger than the cross-sectional dimension of the elastic member 64 to enable the base member 24' and the golf mat 10' to pivot with respect to anchor plate 16'. The opposite ends of the elastic member 64 may be attached to the anchor plate 16' or the base member 24' by any known means. If the elastic member 64 is a closed loop type of member, such as a rubber band, an element may be inserted through the loops at opposite ends to prevent the opposite ends from pulling out through the corresponding hole in either the anchor plate 16' or the base member 24'.

Figure 8:
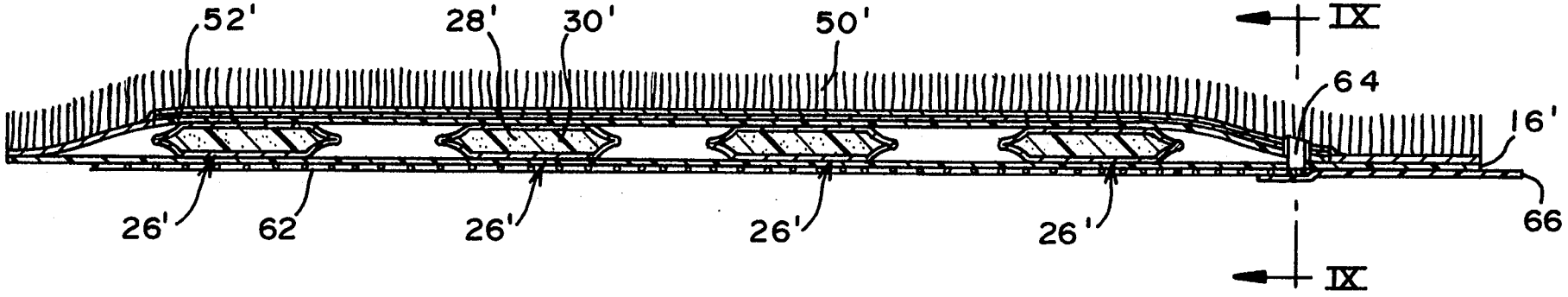
FIG. 8 is a cross-sectional view taken along line VIII—VIII in FIG. 6.
Figure 9:
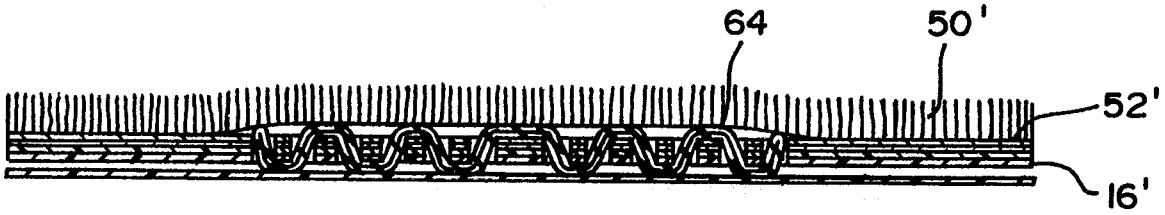
FIG. 9 is a cross-sectional view taken along line IX—IX in FIG. 8.

A cover 66 may be attached to the underside of the front portion of the anchor plate 16' such that a portion of the cover extends over the elastic member 64, as best seen in FIG. 8. The cover member 66 may comprise a thin sheet of flexible material and serves to prevent contact between the elastic member 64 and the support surface on which the golf mat 10' rests. This minimizes wear and prolongs the life of the elastic member 64.

Figure 5:
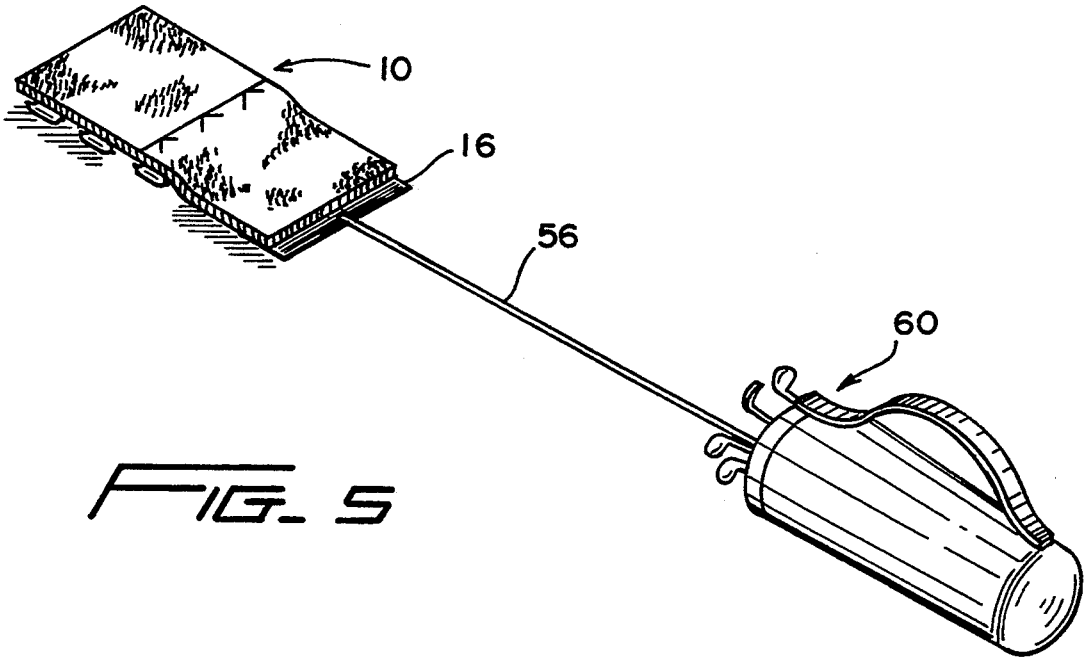
FIG. 5 is a perspective view illustrating an alternative anchoring system for the pivoting golf mat according to the present invention.
Figure 6:
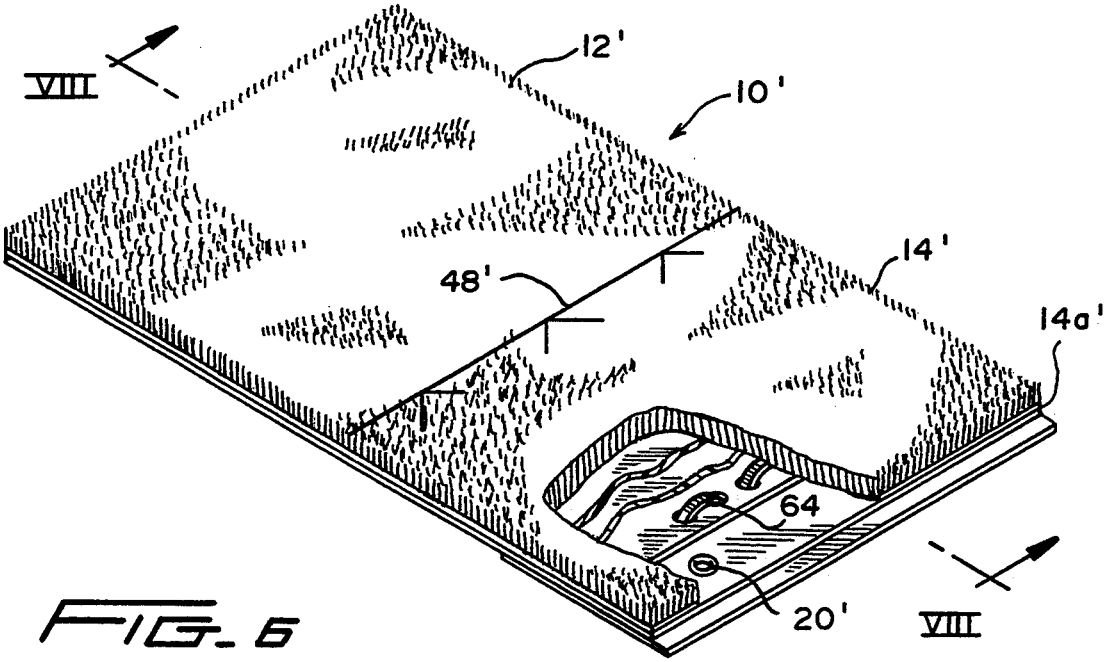
FIG. 6 is a perspective view, partially broken away, illustrating a second embodiment of a pivoting golf mat according to the present invention.
Figure 7:
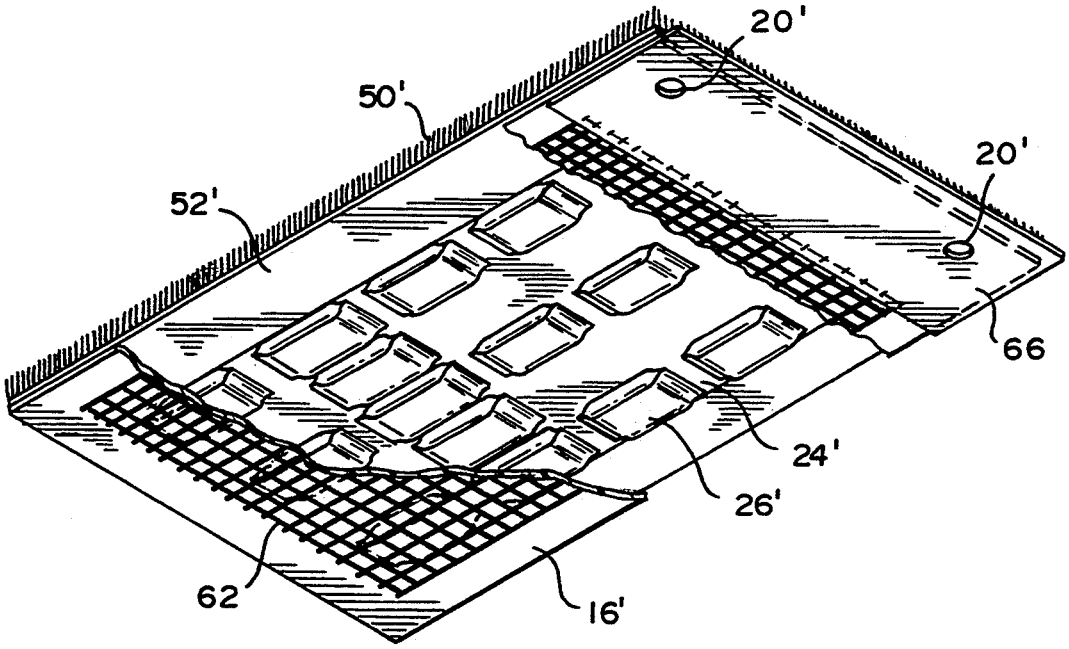
FIG. 7 is a perspective view, partially broken away, illustrating the bottom of the golf mat of FIG. 6.

Again, indicia may be provided on an upper surface of the cover member 66, which extends outwardly beyond the front edge **14*a*' of the golf mat 10' as in the previously described embodiment. Also, anchor plate 16' may be formed with one or more holes 20' through which spikes (not shown) may be inserted to anchor the golf mat onto a support surface. If the golf mat 10' is utilized on a hard surface, it may be tethered as illustrated in FIG. 5 as in the previously described embodiment, although in most cases, the non-slip grid 62** will provide sufficient non-skid properties to the golf mat 10'.

The foregoing description is provided or illustrative purposes only and should not be construed as in any way limiting this invention, the scope of which is defined solely by the appended claims.

I claim:

1. A golf mat assembly to provide a visual indication of the path of a golfers swing comprising:
   a) anchor means;
   b) a golf mat having a hitting surface from which a golf ball can be hit with a golf club;
   c) support means to slidably support the golf mat; and,
   d) pivot attaching means to pivotally attach the golf mat to the anchor means such that contact between the golf mat and a golf club while hitting a golf ball off the hitting surface will cause the golf mat to align itself with the path of the golf club during the swing.

2. The golf mat assembly of claim 1 wherein the anchor means comprises an anchor plate.

3. The golf mat assembly of claim 2 further comprising visual indicia located on the anchor plate to indicate any relative pivoting movement between the anchor plate and the golf mat.

4. The golf mat assembly of claim 3 wherein the visual indicia comprises at least one line extending at least partially across a width of the anchor plate.

5. The golf mat assembly of claim 4 wherein the golf mat has an edge portion in sliding contact with the anchor plate and located adjacent to the at least one visual indicia line.

6. The golf mat assembly of claim 1 wherein the pivot attaching means comprises means to enable the golf mat to pivot with respect to the anchor means about a generally vertical pivot axis.

7. The golf mat assembly of claim 1 wherein the support means comprises a plurality of support feet attached to a bottom portion of the golf mat.

8. The golf mat assembly of claim 7 wherein the support feet comprise a core of resilient foam material.

9. The golf mat assembly of claim 8 wherein the support feet further comprise a cover to substantially enclose the foam core.

10. The golf mat assembly of claim 1 wherein the golf mat defines a hitting area and a ramp area.

11. The golf mat assembly of claim 1 wherein the pivot attaching means comprises:
   a) a tubular member;
   b) a first flexible attaching strand extending through the tubular member and having opposite ends attached to the golf mat; and,
   c) a second flexible attaching strand extending through the tubular member and attached to the anchor means.

12. The golf mat assembly of claim 11 wherein the tubular member is formed of resilient material.

13. The golf mat assembly of claim 1 further comprising a base member attached to an underside of the golf mat.

14. The golf mat assembly of claim 13 further comprising a plurality of support feet attached to the base member.

15. The golf mat assembly of claim 1 wherein the pivot attaching means comprises a resilient band element interconnecting the golf mat and the support means.

16. The golf mat assembly of claim 15 wherein the anchor means comprises an anchor plate.

17. The golf mat assembly of claim 16 wherein the anchor plate comprises a flexible sheet having a non-slip bottom surface.

18. The golf mat assembly of claim 17 wherein the non-slip bottom surface comprises a grid of non-slip material affixed to the anchor plate.

19. The golf mat assembly of claim 16 further comprising a plurality of support feet affixed to the golf mat and slidably contacting the anchor plate.

20. The golf mat assembly of claim 19 further comprising a base member fixedly attached to the golf mat and to the plurality of support feet.

21. The golf mat assembly of claim 20 the resilient band element extends in serpentine fashion through openings defined by the anchor plate and the base member.

* * * * *